US007252579B2

(12) United States Patent
Yen

(10) Patent No.: US 7,252,579 B2
(45) Date of Patent: Aug. 7, 2007

(54) APPARATUS AND PROCESS FOR CYLINDRICALLY GRINDING WORKPIECES

(75) Inventor: Shih-Chieh Yen, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/454,549

(22) Filed: Jun. 16, 2006

(65) Prior Publication Data

US 2007/0105487 A1 May 10, 2007

(30) Foreign Application Priority Data

Nov. 4, 2005 (CN) ..... 2005 2 0066921

(51) Int. Cl.
*B24B 1/00* (2006.01)

(52) U.S. Cl. ..... 451/231; 451/390; 269/9; 269/902

(58) Field of Classification Search ..... 451/41, 451/42, 43, 65, 231, 384, 390, 391, 548, 451/921; 269/9, 37, 43, 902, 909
See application file for complete search history.

(56) References Cited

U.S. PATENT DOCUMENTS

| | | | | |
|---|---|---|---|---|
| 5,727,990 | A * | 3/1998 | Hasegawa et al. | 451/44 |
| 6,062,969 | A * | 5/2000 | Klicpera | 451/548 |
| 6,215,945 | B1 * | 4/2001 | Fukuyama et al. | 385/137 |
| 6,358,133 | B1 * | 3/2002 | Cesena et al. | 451/450 |
| 7,144,306 | B1 * | 12/2006 | Yen | 451/57 |
| 2002/0084565 | A1 * | 7/2002 | Dautartas et al. | 269/289 R |

* cited by examiner

*Primary Examiner*—Jacob K. Ackun, Jr.
(74) *Attorney, Agent, or Firm*—Jeffrey T. Knapp

(57) ABSTRACT

An apparatus for cylindrically grinding workpieces includes a first holding tool (10), a second holding tool (12), and a grinding wheel (14). The first holding tool is configured for positioning un-ground workpieces (18), and the first holding tool defines a plurality of first grooves (104) for containing the un-ground workpieces to be partially ground. The second holding tool is configured for positioning the partially ground workpieces, and the second holding tool defines a plurality of second groove (124) for containing the partially ground workpieces. The grinding wheel defines a plurality of grinding grooves (142) for grinding the workpieces.

9 Claims, 2 Drawing Sheets

APPARATUS AND PROCESS FOR CYLINDRICALLY GRINDING WORKPIECES

TECHNICAL FIELD

The present invention generally relates to grinding apparatuses and processes and, more particularly, to an apparatus and a process for cylindrically grinding workpieces.

BACKGROUND

Usually, optical elements such as camera lenses and spectacles are in used in cylindrical form. However, optical workpieces (i.e. lens blanks) are most easily manufactured in square form. Therefore, these original optical workpieces have to be cylindrically ground before use.

A typical example of a contemporary cylindrical grinding apparatus is a centering apparatus. The centering apparatus typically includes a pair of holders for holding the original workpiece, where each holder has a hollow chamber communicating with a surface of the holder. The holder can hold the workpiece on its surface by using an air pump pumping the hollow chamber, a grinding wheel is then used to cylindrically grind the workpiece. However, such a centering apparatus can only cylindrically grind one workpiece at a time.

Therefore, an apparatus and a process for cylindrically grinding workpieces which can overcome the above-described problems is desired.

SUMMARY

In one aspect of the preferred embodiment, an apparatus for cylindrically grinding workpieces includes a first holding tool, a second holding tool, and a grinding wheel. The first holding tool is configured for positioning un-ground workpieces, and the first holding tool defines a plurality of first grooves for containing the un-ground workpieces to be partially ground. The second holding tool is configured for positioning the partially ground workpieces, and the second holding tool defines a plurality of second grooves for containing the partially ground workpieces. The grinding wheel defines a plurality of grinding grooves for grinding the workpieces.

In another aspect of the preferred embodiment, a process for grinding workpieces can be used wherein a plurality of un-ground workpieces are positioned in a plurality of first grooves of a first holding tool with a first portion of the un-ground workpieces projecting out of the first grooves. The first portion of the un-ground workpieces is partially ground into a first predetermined shape using a plurality of grinding grooves of a grinding wheel. The partially ground workpieces are transferred into a plurality of second grooves of a second holding tool with a second portion of the workpieces projecting out of the second grooves. This second portion is then ground into a second predetermined shape using the grinding grooves of the grinding wheel, thus completing the grinding process.

Other advantages and novel features will become more apparent from the following detailed description when taken in conjunction with the accompanying drawings.

BRIEF DESCRIPTION OF THE DRAWINGS

Many aspects of the apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE EMBODIMENT

Figure 1:
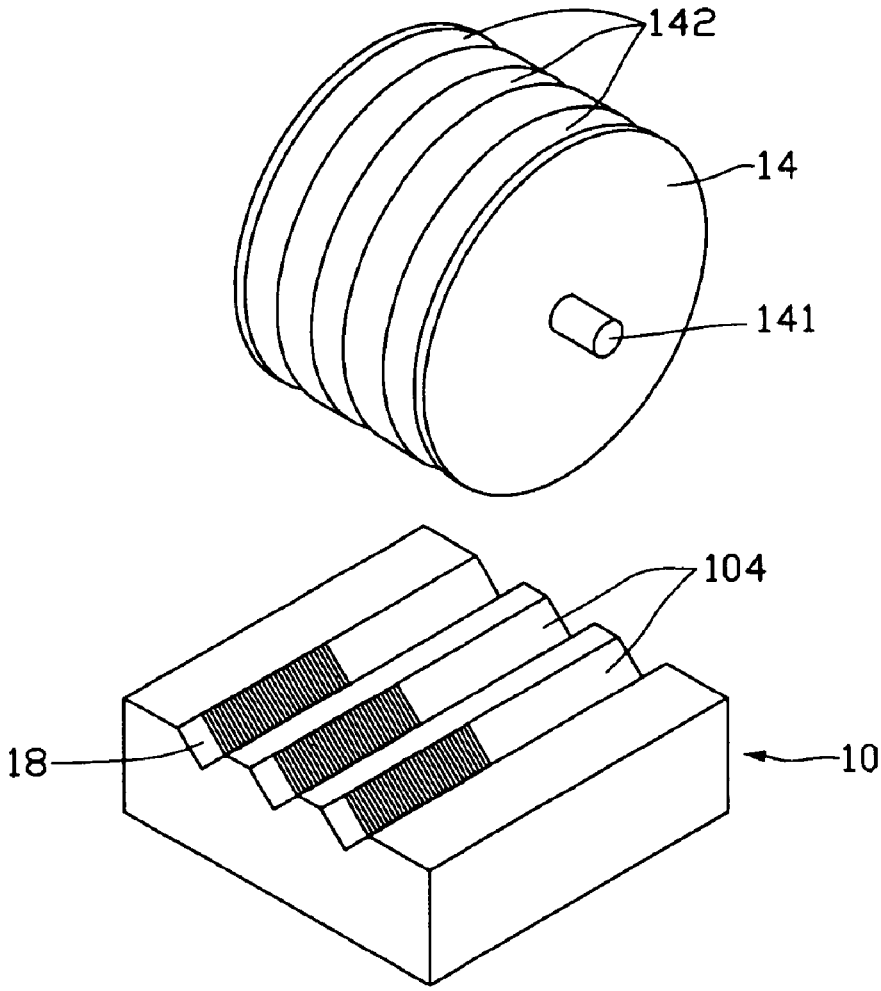
FIG. 1 is a schematic view of a first holding tool of an apparatus for cylindrically grinding workpieces in accordance with a preferred embodiment.
Figure 2:
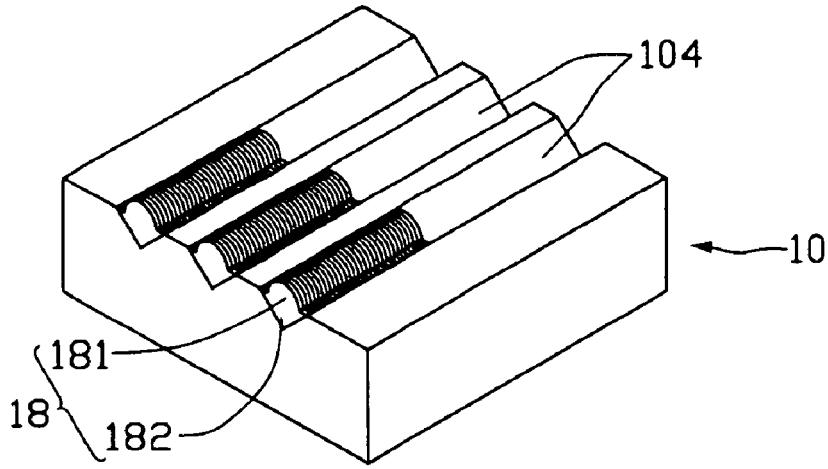
FIG. 2 is a schematic view of a stage of the process for cylindrically grinding workpieces in accordance with a preferred embodiment.
Figure 3:
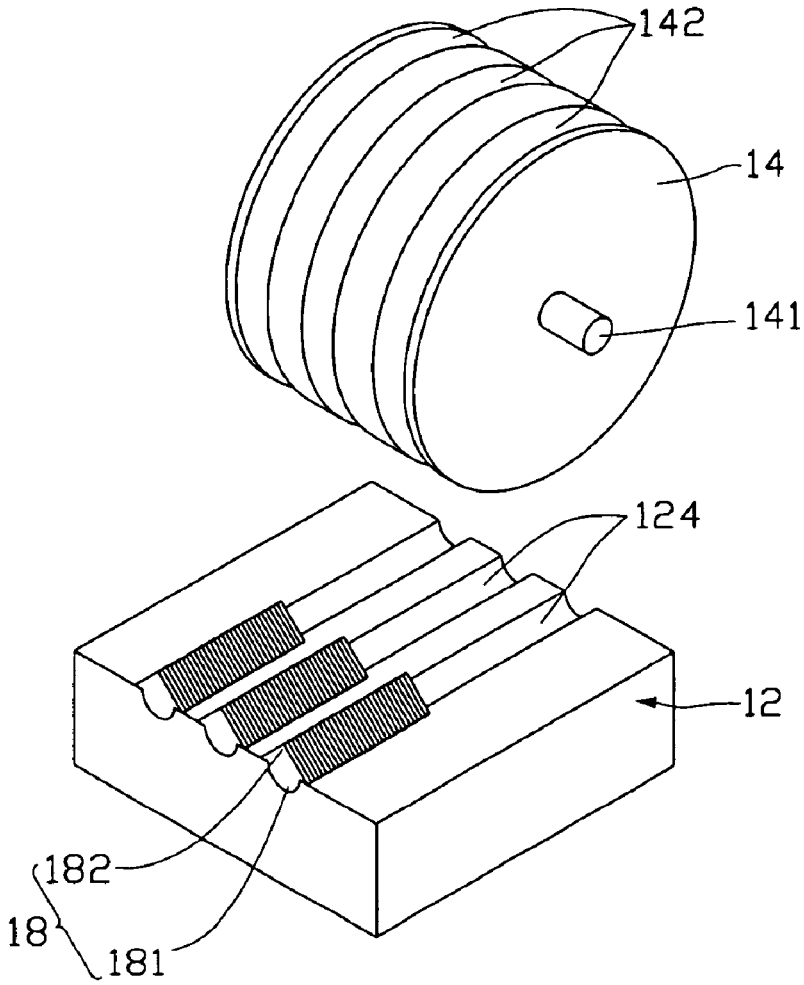
FIG. 3 is a schematic view of subsequent step showing use of a second holding tool of the apparatus.
Figure 4:
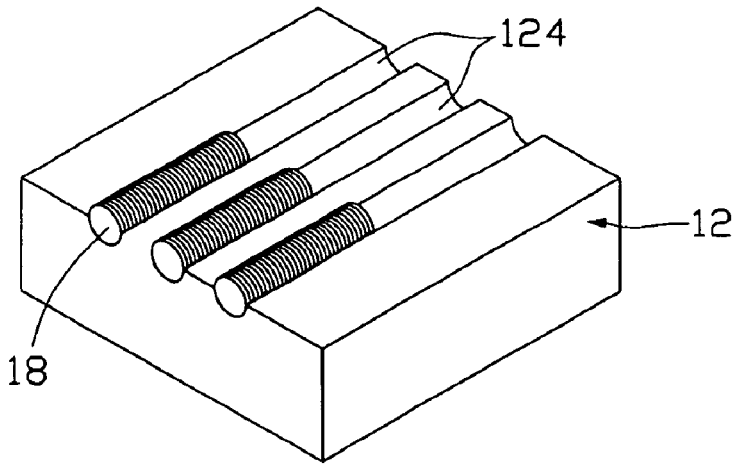
FIG. 4 is a schematic view of finished workpieces in FIG. 3.

Referring to FIGS. 1 and 3, in a preferred embodiment, an apparatus for cylindrically grinding workpieces 18, includes a first holding tool 10, a second holding tool 12, and a grinding wheel 14. The holding tools 10, 12 are configured for bonding workpieces 18.

The first holding tool 10 defines three first grooves 104 for containing un-ground workpieces 18. The un-ground workpieces 18 can be optical elements having a non-cylindrical shape. In this preferred embodiment, the workpieces 18 are in substantially square form. Therefore, the first grooves 104 are configured to have a V-shaped cross section, for receiving the un-ground workpieces 18 therein. Understandably, the cross section of the first grooves 104 can be of other shape depending on the form of the un-ground workpieces 18. The un-ground workpieces 18 are partially ground on the first groove 104 using the grinding wheel 14. Each groove 104 is separated from its neighbouring grooves 104 by a predetermined distance.

The second holding tool 12 defines three second grooves 124 for containing the partially ground workpieces 18. The second groove 124 is configured to have a semicircular cross section. The partially ground workpieces 18 are ground to be cylinder shape on the second grooves 124. Each second groove 124 is separated from its neighbouring grooves 124 by a distance identical to that separating each first groove 104 from its neighbouring grooves 104.

The grinding wheel 14 can be disposed above the first holding tool 10 or the second holding tool 12. The grinding wheel 14 is substantially cylindrical in form, and defines three grinding grooves 142. Each of the grinding grooves 142 has a semicircular cross section. Each grinding groove 142 is separated from its neighbouring grooves 142 by a distance identical to that separating each first groove 104 from its neighbouring grooves 104. The grinding wheel 14 is connected to a driving mechanism 141 which can drive the grinding wheel 14 to rotate. In this embodiment, the driving mechanism 14 is a motor.

Understandably, the first holding tool 10 can have more than three first grooves 104. The second holding tool 12 can also have more than three second grooves 124 so long as the number of the second grooves 124 is the same as that of the first grooves 104. The number of the grinding grooves 142 can also be the same as that of the first grooves 104 and the second grooves 124.

Referring to FIGS. 1-4, an exemplary process for cylindrically grinding workpieces 18 includes the steps of:

(1) A stack of workpieces 18 (i.e. un-ground workpieces) are placed in the first grooves 104 of the first holding tool 10. A first portion 181 of each of the un-ground workpieces 18 projects out of the first grooves 104.

(2) The un-ground workpieces 18 are bonded together in the first grooves 104 using an adhesive.

(3) The first portion 181 of each of the un-ground workpieces 18 is partially ground to a semicircular shape.

(4) The partially ground workpieces 18 are transferred to the second grooves 124 of the second holding tool 12 with a second portion 182 of the workpieces 18 projecting out of the second grooves 124.

(5) The second portion 182 of the workpieces 18 are ground to a semicircular shape.

(6) The bonded workpieces 18 are detached and cleaned after the second portion 182 of each of the workpieces 18 is ground and a plurality of cylindrical workpieces 18 are obtained.

The apparatus can rapidly grind a large number of workpieces 18 into cylinder shape in one cycle, which can promote the working efficiency of the grinding process.

It is believed that the present embodiments and their advantages will be understood from the foregoing description, and it will be apparent that various changes may be made thereto without departing from the spirit and scope of the invention or sacrificing all of its material advantages, the examples here before described merely being preferred or exemplary embodiments of the invention.

What is claimed is:

1. An apparatus for cylindrically grinding workpieces, comprising:

a first holding tool for positioning un-ground workpieces, the first holding tool defining a plurality of first grooves for containing the un-ground workpieces to be partially ground;

a second holding tool for positioning the partially ground workpieces, the second holding tool defining a plurality of second grooves for containing the partially ground workpieces; and a grinding wheel defining a plurality of grinding grooves configured for grinding the workpieces.

2. The apparatus as claimed in claim 1, wherein each of the first grooves has a V-shaped cross section.

3. The apparatus as claimed in claim 1, wherein each of the second grooves has a semicircular cross section.

4. The apparatus as claimed in claim 1, wherein each of the grinding grooves has a semicircular cross section.

5. The apparatus as claimed in claim 1, wherein the second grooves and the grinding grooves have identical cross sections.

6. The apparatus as claimed in claim 1, wherein the grinding wheel is connected to a driving mechanism.

7. The apparatus as claimed in claim 6, wherein the driving mechanism is a motor.

8. The apparatus as claimed in claim 1, wherein each first groove is separated from its neighbouring first grooves by a distance identical to that between each grinding groove and its neighbouring grinding grooves.

9. The apparatus as claimed in claim 1, wherein each second groove is separated from its neighbouring second grooves by a distance identical to that between each grinding groove and its neighbouring grinding grooves.

* * * * *